109-82 SR
6/28/83 OR 4,389,948

United States Patent [19]
Sands et al.

[11] 4,389,948
[45] Jun. 28, 1983

[54] SECURITY ENCLOSURES

[75] Inventors: Raymond L. Sands, Solihull; Geoffrey M. Ward, Wombourne, both of England

[73] Assignee: Chubb & Son's Lock and Safe Company Limited, London, England

[21] Appl. No.: 284,293

[22] Filed: Jul. 17, 1981

[30] Foreign Application Priority Data

Jul. 18, 1980 [GB] United Kingdom ..... 8023615

[51] Int. Cl.[3] ..... E04B 2/02
[52] U.S. Cl. ..... 109/82
[58] Field of Search ..... 109/82, 80, 81, 84; 52/284, 264, 79.1, 262

[56] References Cited

U.S. PATENT DOCUMENTS

| | | | |
|---|---|---|---|
| 1,749,222 | 3/1930 | Merriam | 109/74 |
| 2,279,110 | 4/1942 | Collins | 109/82 |
| 2,655,882 | 10/1953 | Tripp | 109/82 |
| 3,095,838 | 7/1963 | Paulos et al. | 109/80 |
| 3,408,966 | 11/1968 | Gartner | 109/80 |
| 3,709,169 | 1/1963 | Gauger et al. | 109/80 |
| 3,732,831 | 5/1973 | Marciniak | 109/82 |

*Primary Examiner*—Gene Mancene
*Assistant Examiner*—Wenceslao J. Contreras
*Attorney, Agent, or Firm*—Pollock, Vande Sande & Priddy

[57] ABSTRACT

A vault constructed by assembling together, in demountable fashion, a plurality of separate, pre-fabricated panels. Each perpendicular corner of the assembled vault is provided in a panel which extends integrally from the respective corner to define significant portions of both of the adjacent sides of the vault, thereby avoiding the security weakness of separate orthogonally-jointed panels at those corners. In addition each panel comprises a steel plate upon which is cast a barrier material of high penetration resistance but relatively low weight, consisting of fibre-reinforced concrete.

16 Claims, 18 Drawing Figures

Fig. 1.
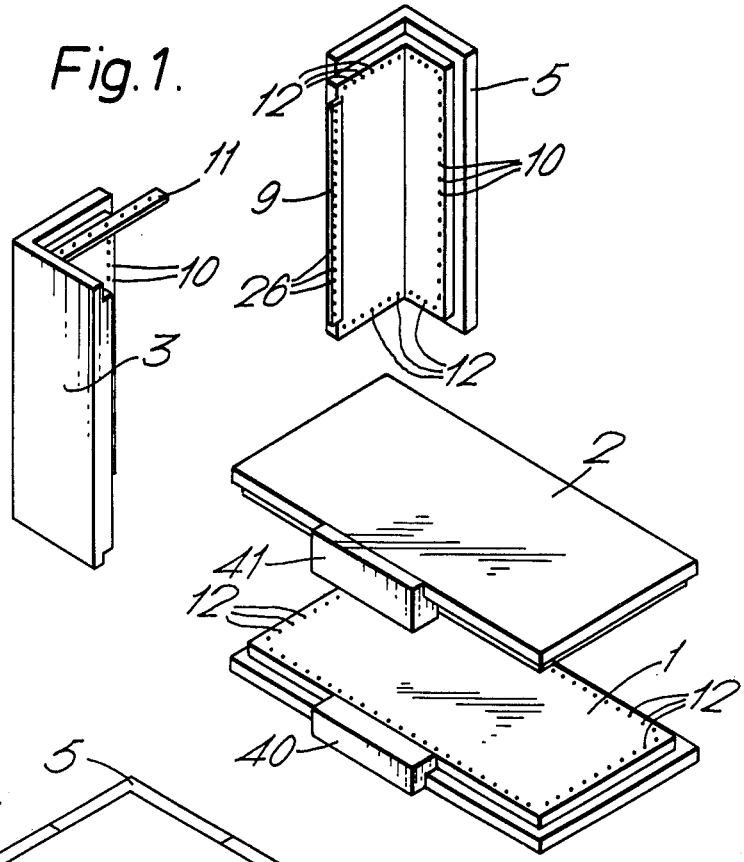
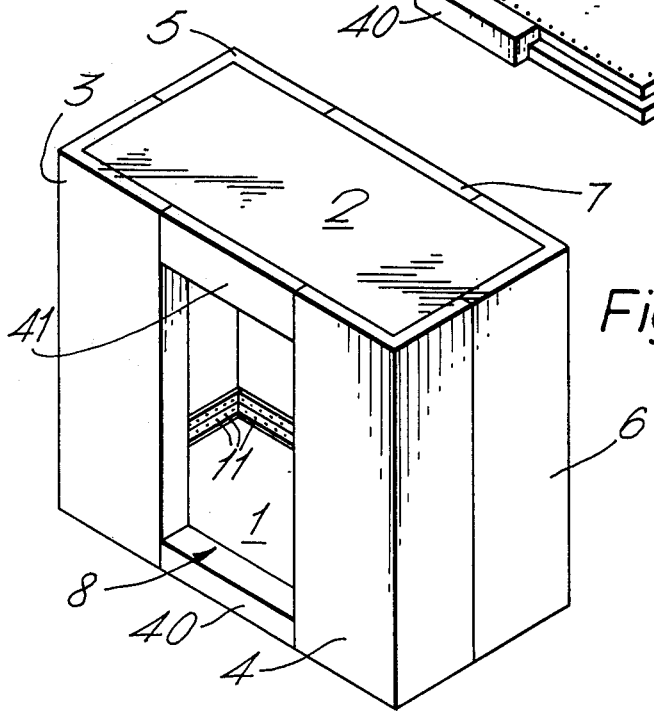
Fig. 2.

SECURITY ENCLOSURES

The present invention relates to vaults, strongrooms safes and the like security enclosures (hereinafter, for brevity, referred to collectively as "vaults"). More particularly, the invention is concerned with vaults which are constructed by assembling together a plurality of separate pre-fabricated panels. Such vaults have the advantage that they can be erected on site more quickly and with less mess and disruption than is occasioned by the building operations associated with traditional vault construction. Likewise, in appropriate cases they can be readily dismantled and moved to new premises if required, without causing damage to the building being vacated. Furthermore, they make it possible, by partial disassembly of the vault and subsequent re-assembly with a greater number of panels, to increase the useful volume of the vault. Vaults of this nature accordingly permit greater flexibility in the choice and movement of premises by banks for example, and can readily cater for changes in storage space requirements.

Such vaults are known. However, a difficulty has existed in relation to the types of pre-fabricated vault hitherto available in providing the vault with sufficient security against burglarious attack while at the same time avoiding excessive wall thickness, weight, cost and complexity of construction. In particular the joints of prior pre-fabricated vaults are considered to be especially vulnerable to certain forms of attack where separate side panels are juxtaposed orthogonally at the perpendicular corners of the vault.

The present invention seeks to provide a form of construction for pre-fabricated vaults whereby the above-mentioned drawbacks can be overcome, and accordingly in one aspect the invention resides in a security enclosure which is constructed by assembling together in demountable fashion a plurality of separate, pre-fabricated panels, wherein each perpendicular corner of the assembled enclosure is provided in at least one panel which extends integrally from the respective corner to define significant portions of both of the adjacent sides of the enclosure, and wherein at least each such corner panel is provided with a penetration-resistant barrier consisting essentially of a fibre-reinforced concrete material. The invention also resides in the panels required to make up an enclosure as defined above, per se.

A vault construction in accordance with the invention can thus avoid the orthogonal jointing of separate panels at the perpendicular corners of the enclosure. Furthermore, the fibre-reinforced concrete material which is employed in at least the corner panels, and preferably all other panels of the body of the enclosure too, is of advantage in being able to provide an adequate degree of penetration resistance without requiring an excessive thickness of material, has a relatively low specific gravity, is not excessively expensive and is readily amenable to manufacture of barriers in the shapes and sizes required for pre-fabricated vault panels. The fibres employed in the concrete barrier material are preferably steel fibres, but polypropylene fibres are an alternative.

In one arrangement of a vault according to the invention there are four said corner panels with two of said panels being interconnected by a uni-planar panel to define a first side of the assembled vault, a space between the free edges of the other two said corner panels defines a door opening for the assembled vault in a second side thereof opposite to said one side, and a uni-planar panel provides the roof of the assembled vault. Such a structure can be conveniently extended in useful volume by the interposition of n similar uni-planar panels between two said corner panels in each of the third and fourth sides of the assembled vault and n similar uni-planar panels serially disposed in the roof thereof, where n is any whole number. Other arrangements are possible, however, as will be apparent from the ensuing particular description of preferred embodiments.

The invention will now be more particularly described, by way of example, with reference to the accompanying drawings, in which:

FIG. 1 is a partially "exploded" view of some of the panels employed to make up a first embodiment of a vault in accordance with the invention;

FIG. 2 is an isometric view of an assembled vault employing the panels of FIG. 1;

Figure 3:
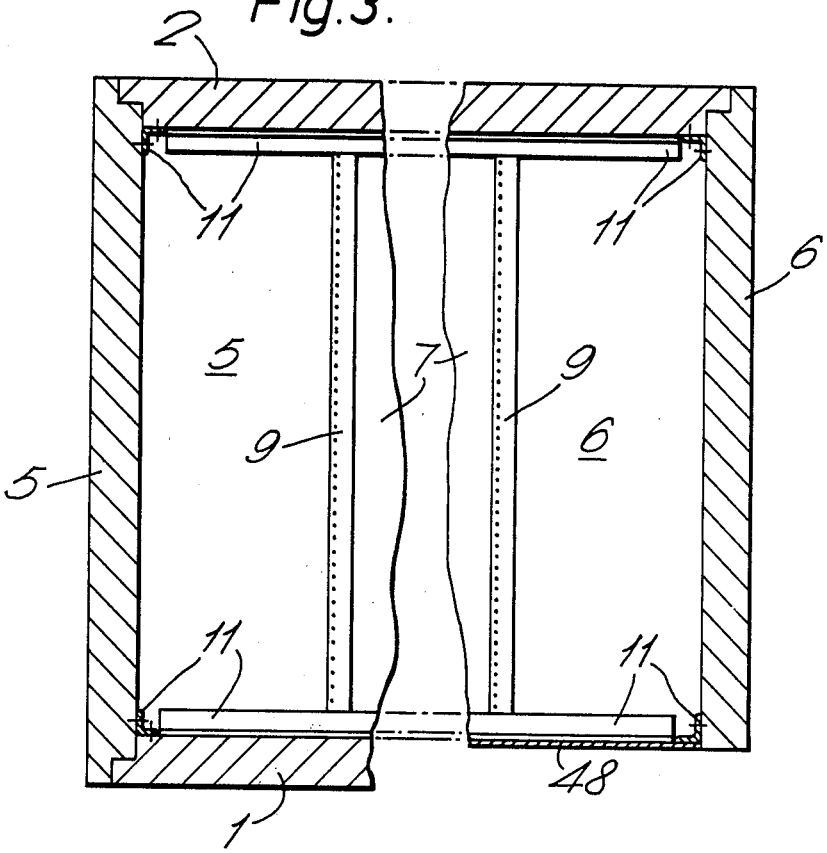
FIG. 3 is a schematic vertical section through the vault of FIG. 2, showing also a modification to the floor of the vault.
Figure 4:
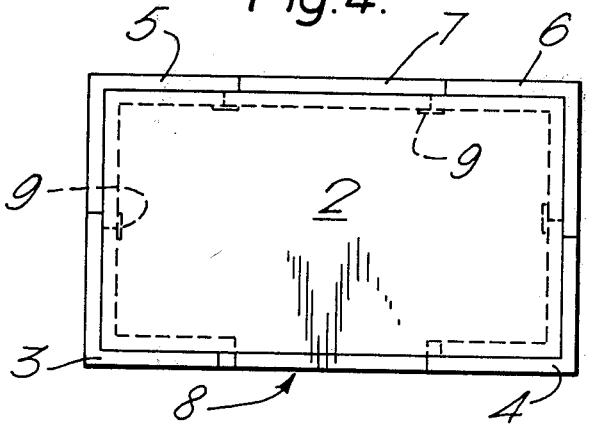
FIG. 4 is a plan view of the vault of FIG. 2.

Referring to FIGS. 1 to 4, these indicate the construction of a first embodiment of pre-fabricated vault in accordance with the invention. The assembled vault, as illustrated in FIG. 2, comprises a floor panel 1, a roof panel 2, four corner panels 3 to 6, and a rear panel 7, all connected together in demountable fashion. Each panel comprises a steel plate (on the side of the panel facing inwards in the assembled vault) to which is anchored a layer of fibre-reinforced concrete, the construction of individual panels being described in more detail hereafter. Except for the edges of the panels which define the door opening 8 (of which more details will appear hereafter) each panel is formed around its edges to provide half lap joints which interfit with the corresponding formations on the neighbouring panels. The over-lapping joints so-formed ensure accurate relative location of the panels and preclude the possibility of direct access being gained to the interior of the vault through the joints.

All panel-to-panel connections are made internally of the vault and none of the fixings are visible from its exterior. Each joint between adjacent corner and rear panels 3/5/7/6/4 is secured by means of a steel flitch plate 9 (FIGS. 1 and 4) which is welded along the vertical edge of one of the abutting panels and has a series of drillings which align with tapped holes 10 (FIG. 1) along the vertical edge of the other panel, screws being passed through the flitch plate and into the holes 10. The joints between the corner and rear panels and the floor and roof panels 1 and 2 are secured by steel angles 11 (FIGS. 1 to 3) which have a series of drillings in each leg which align with tapped holes 12 (FIG. 1) along the adjacent horizontal edges of the panels, screws being passed through the angles and into the holes 12.

The typical internal dimensions of the vault shown in FIG. 2 may be 2.00 meters high by 2.16 meters wide by 1.09 meters deep to give an internal volume of 4.71 cubic meters. This may be increased by the incorporation of additional panels into the basic module of FIG. 2, e.g. as shown in FIGS. 5 and 6.

Figure 5:
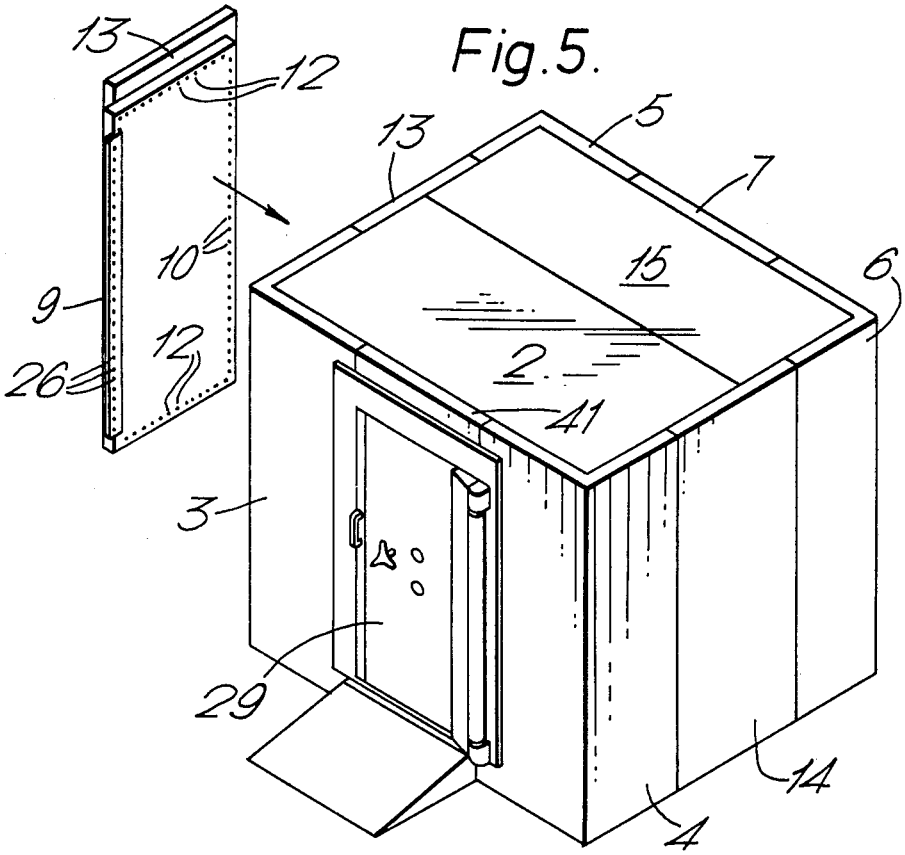
FIG. 5 is an isometric view of an extended version of the vault of FIG. 2.
Figure 6:
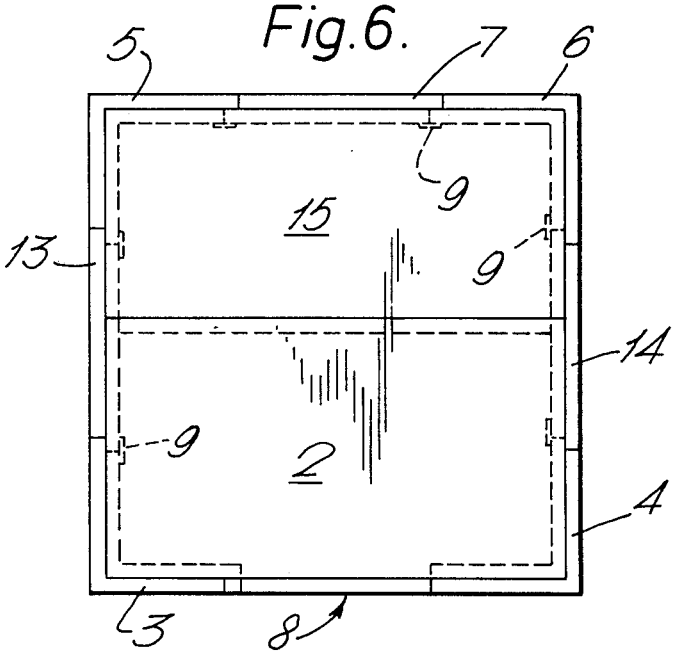
FIG. 6 is a plan view of the vault of FIG. 5.

In the example of FIGS. 5 and 6 four new panels, each identical to the original back panel 7, have been added, as follows: a panel 13 between original corner panels 3 and 5; a panel 14 at a corresponding position between original corner panels 4 and 6; a panel 15 in the roof behind the original roof panel 2; and a panel (not shown) in the floor at a corresponding position behind the original floor panel 1. These panels are fixed by flitch plates and angles in the same way as for the basic module. The effect of these additions is to increase the overall depth of the vault by a dimension equal to the width of a panel 13 etc, less its overlap. This may be typically 1.07 meters, to give an increase in internal volume of 4.62 cubic meters.

Figure 7:
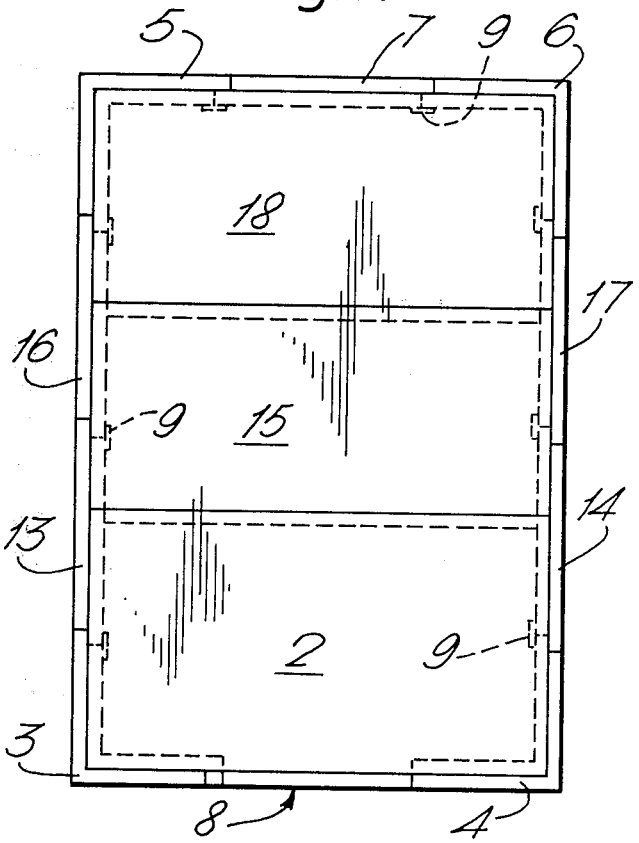
FIG. 7 is a plan view of a further extended version of the vault of FIG. 2.

FIG. 7 illustrates a still further extended vault in which further panels 16 and 17 have been added to the sides, a further panel 18 to the roof, and another (not shown) in a corresponding position to the floor. As will be appreciated, panels can continue to be added in this fashion to provide corresponding incremental increases in depth and internal volume of the vault up to any desired value.

Figure 8:
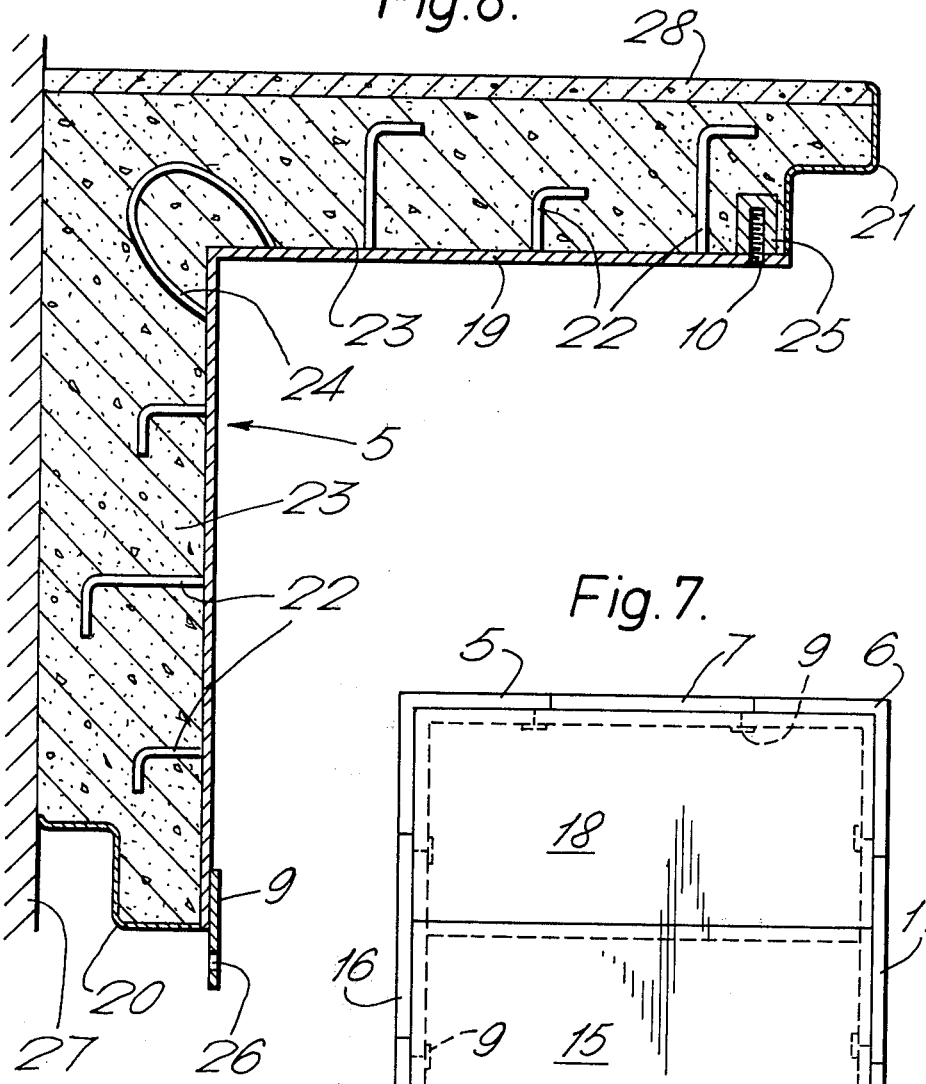
FIG. 8 is a horizontal section through a corner panel of the vault of FIG. 2.

Turning now to FIG. 8 this shows in more detail a preferred form of construction for a corner panel of the vault, for example panel 5. It comprises an L-shaped mild steel plate 19, typically 10 mm thick, along each edge of which are welded mild steel edge pieces such as 20 and 21 formed to give the required jointing shape. Also welded to each leg of the plate 19 are a plurality of L-shaped anchors 22, to resist separation of the subsequently-applied fibre-reinforced concrete layer 23 from the plate. In some embodiments these anchors may be applied in an irregular pattern to increase the difficulty of locating and destroying them in a burglarious attack. Hoop-shaped anchors 24 are welded to the plate in its corner region for the same purpose as anchors 22. Adjacent to one vertical edge of the panel steel blocks 25 are welded to the plate 19, the plate and each block being drilled and tapped as indicated at 10 to receive the screws by which adjacent panels are connected together. The figure also shows a flitch plate 9 welded to the plate 19 along the other vertical edge of the panel, the flitch plate being drilled with through-holes as indicated at 26 for the passage of the connecting screws. As will be appreciated each integral leg of the panel extends from the corner region of the panel to define a significant portion of the corresponding side of the assembled vault, and by using panels of this type the jointing of separate panels at the perpendicular corners of the vault can be avoided entirely. In the case of a vault having the dimensions exemplified above each leg of each corner panel may have a length of typically 0.745 meters.

The form of construction adopted for the floor, roof, rear and side panels 1,2,7 and 13 etc, is essentially the same as for the corner panels, except that they are based on a uni-planar steel plate and will not employ, of course, the corner hoop anchors 24.

The reinforced concrete layer 23 of each panel is preferably a Portland cement-based matrix within which there is an evenly distributed randomly orientated mass of steel fibres. The fibres may be present in an amount representing 2½%–5% by weight of the concrete mix, and are preferably unalloyed steel fibres of a length typically in the range of 0.3–1 mm. (or of an equivalent non-circular cross-section), and may have hooked ends. The concrete preferably includes a hard, coarse aggregate, such as quartzite, and for increased penetration resistance a proportion of synthetic aggregate such as sintered or fused alumina (eg Aloxite-Registered Trade Mark) or the like very hard and refractory compound may also be included, which latter may be present in an amount representing 10–40% by volume of the concrete mix and with a typical particle size of 10–16 mm. A concrete formulated as above typically has a density of 2700 $Kg/m^3$ (165 $lb/ft^3$) and a compressive strength of 95 MPa (14,000 $lbf/in^2$).

In the manufacture of the panels, the respective plate (i.e. plate 19 in the case of the illustrated panel 5) is first prepared with its edge pieces (20 and 21), anchors (22 and 24), screw blocks (2) and flitch plate (9), and the wet concrete is then poured and vibrated into the tray defined by the plate and its edge pieces, the corner panels being shuttered on one side as indicated at 27 in FIG. 8 during this filling process. The reinforced concrete is applied to within, say, 20 mm of the top surface of the "tray" and this gap is then filled with a layer of non-reinforced concrete 28 and "floated" to obtain a smooth flat fibre-free surface. On the shuttered side of a corner panel the reinforced concrete layer 23, of course, extends to the full thickness of the panel. The overall thickness of the panels may be typically 160 mm.

The door 29 (FIG. 5) which is fitted in the opening 8 of the vault may have a fibre-reinforced on concrete steel construction similar to the above-described panels, or may be of known construction employing other types of barrier material, and in particular may be one of the existing range of strongroom/vault doors marketed by the present applicants. The door is hung on a frame which may be fixed in the opening 8 eg as indicated schematically in FIG. 9 or FIG. 10.

Figure 9:
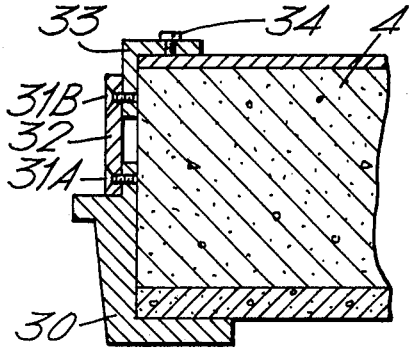
FIG. 9 is a schematic horizontal section through part of a door frame and an adjacent panel of the vault of FIG. 2.

In FIG. 9 an angle-sectioned door frame 30 is shown which, at each side of the door opening, is screwed as indicated at 31A to a plate 32, the latter in turn being screwed as indicated at 31B to a rear angle plate 33. The plate 33 shown in the figure is provided with jacking screws 34 which bear against the rear face of the corner panel 4 of the vault as they are turned, thereby tightly clamping the assembly 30/32/33 to the free end of the panel. A similar arrangement pertains at the free end of the corner panel 3 at the other side of the door opening.

Figure 10:
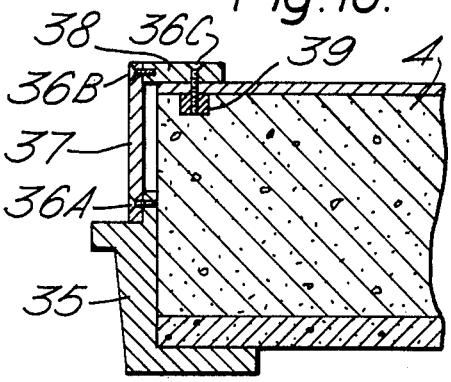
FIG. 10 is a schematic horizontal section through part of an alternative door frame and an adjacent panel of the vault of FIG. 2.

The arrangement of FIG. 10 is similar in that there is a door frame 35 which, at each side of the door opening, is screwed as indicated at 36A to a plate 37. In this case, however, the plate 37 is screwed as indicated at 36B to a bar 38 which latter is screwed as indicated at 36C to tapped blocks 39 welded to the inner plate of the adjacent panel of the vault in the nature of the previously-described blocks 25.

To bridge the gaps which would otherwise be left between the door frame and the half-lap portions of the floor and roof panels 1 and 2 below and above the door frame, the floor and roof panels are provided with respective fill-in pieces 40 and 41 (FIGS. 1, 2 and 5). These fill-in pieces are again of fibre-reinforced concrete on steel construction and are welded to the floor and roof panels at the appropriate positions prior to the fitting of the door frame.

Figure 11:
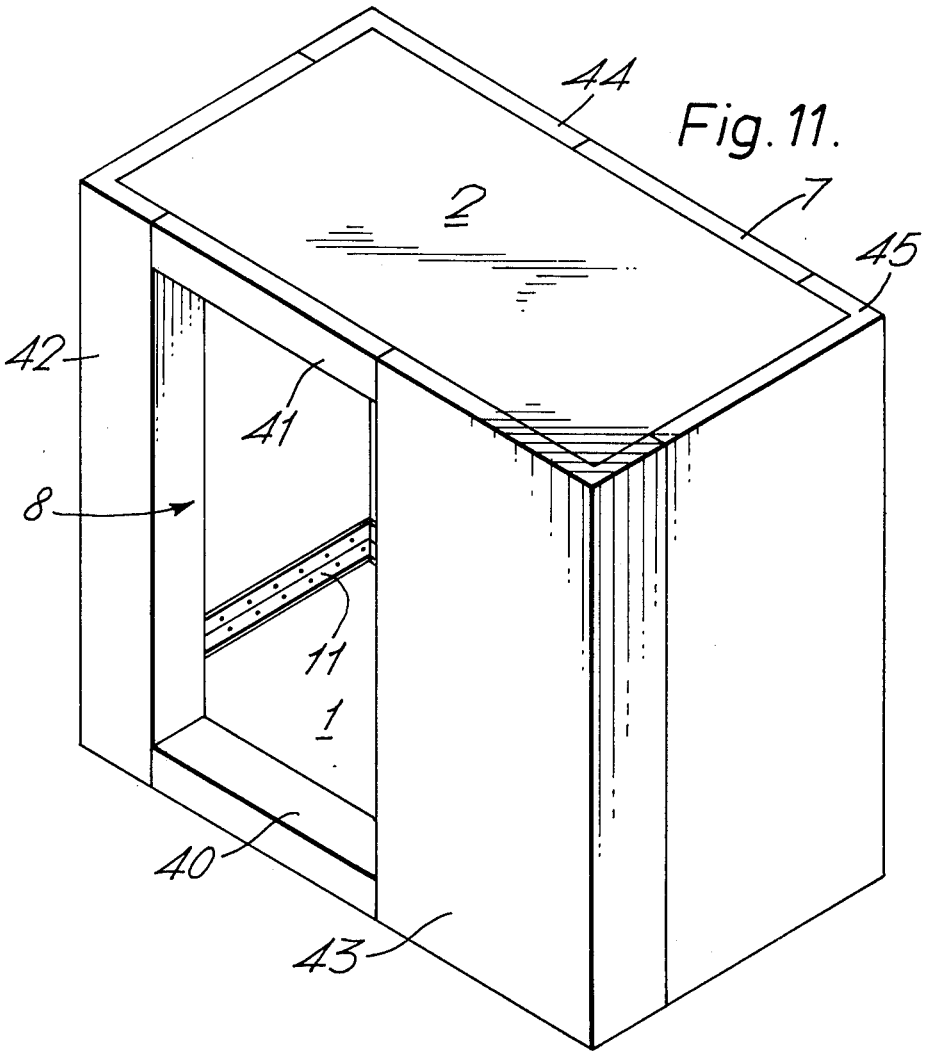
FIG. 11 is an isometric view of a second embodiment of a vault in accordance with the invention.

As will be appreciated from FIGS. 1 and 2, etc., the legs of each corner panel 3–6 of the vault so far described are of equal length, so that the door opening 8 is located centrally in the front side of the vault. In other embodiments, however, it may be desirable to have the door located in an off-centre position and this can be readily achieved by the provision of corner panels having unequal leg lengths. Such an embodiment is illustrated in FIG. 11, in which there are four corner panels 42–45 in each of which the legs are of unequal length, the remaining components being the same as in the embodiment of FIGS. 1 and 2 and being denoted by the same reference numerals. In the embodiment of FIG. 11 the door opening 8 is located to the left of centre as viewed from the front of the vault. Since, however, the assembly of panels is symmetrical about a central horizontal plane it will be appreciated that the same panels can also be assembled in an "inverted" condition, in which case the door opening will be located to the right of centre as viewed from the front of the assembled vault. The lengths of the legs in each corner panel of this embodiment may be typically 1.14 meters and 0.35 meters respectively.

Figure 12:
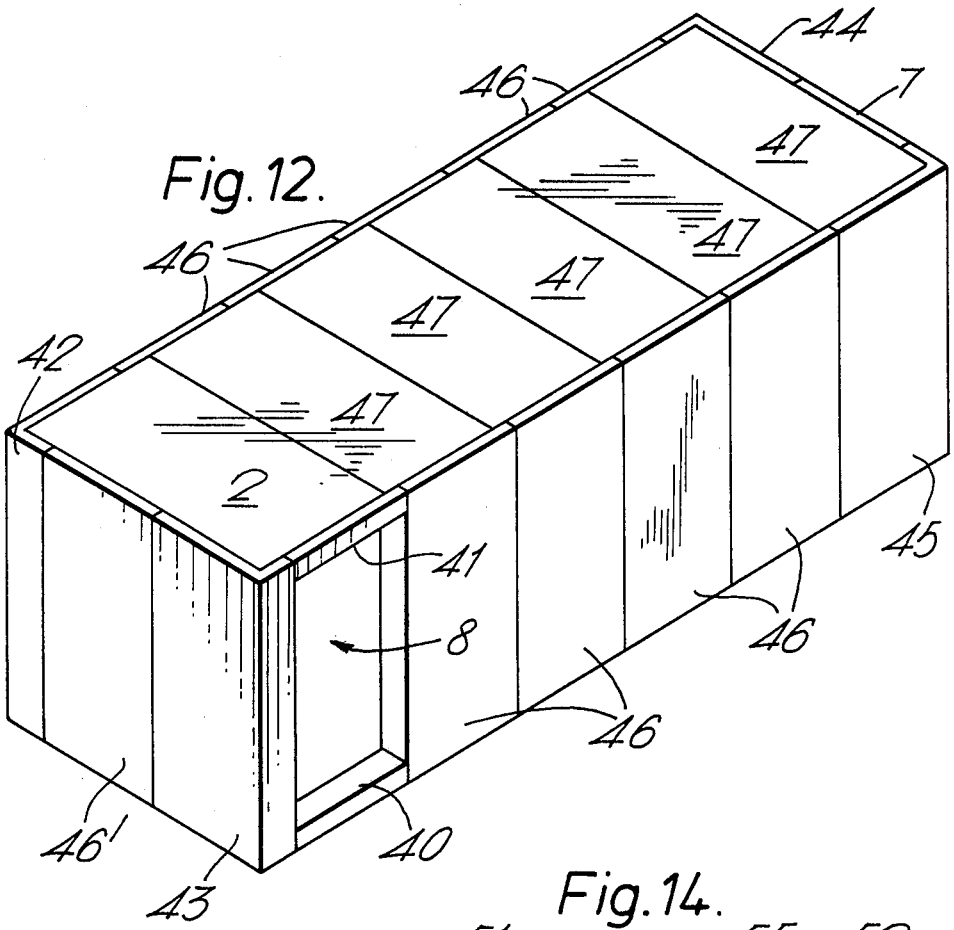
FIG. 12 is an isometric view of an extended version of the vault of FIG. 11.

The internal volume of a vault such as is shown in FIG. 11 can be increased by the incorporation of additional panels in an analagous fashion to the extension of the vault of FIGS. 1 and 2 previously described. Such an extended example is shown in FIG. 12, in which the panels of FIG. 11 have been assembled with ten additional side panels 46, 46', five additional roof panels 47 and a corresponding number of additional floor panels. FIG. 11 also indicates the optional location of the door opening 8 in the long side of the extended vault instead of in the front position adopted in FIG. 11, which is occupied by the panel 46' in the illustrated extended example; (this optional positioning of the door opening is also possible for embodiments such as are illustrated in FIGS. 4–7).

In any of the above-described embodiments, as an alternative to the illustrated floor panel(s), floor plates of e.g. 10 mm thick steel may be used, such a plate being indicated at 48 in the sectional view of FIG. 3. In any such example the half lap joints at the lower edges of the corner, side and rear panels of the vault will be dispensed with.

As a further modification, the corner, side and rear panels of any of the above described embodiments may each be made in two half-height portions to be assembled one above the other. The joints between the half panels in each pair will preferably be lapped as in the case of the joints between adjacent panels described above, and may be secured e.g. with horizontal flitch plates welded and screwed to the half panels again as described above.

Figure 14:
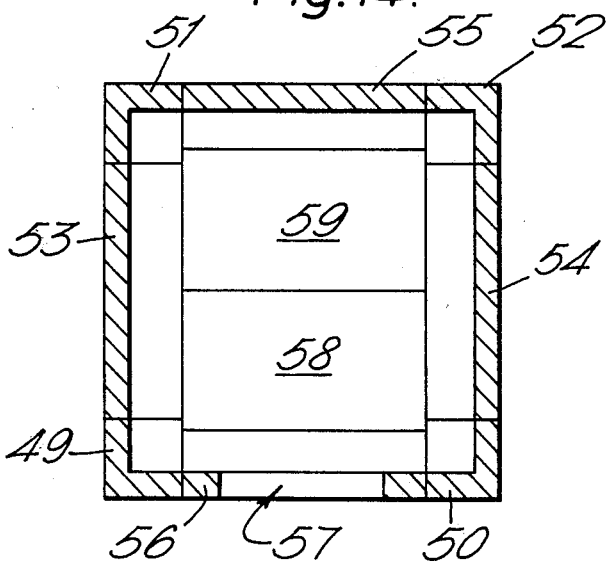
FIG. 14 is a horizontal section through the vault of FIG. 13.
Figure 13:
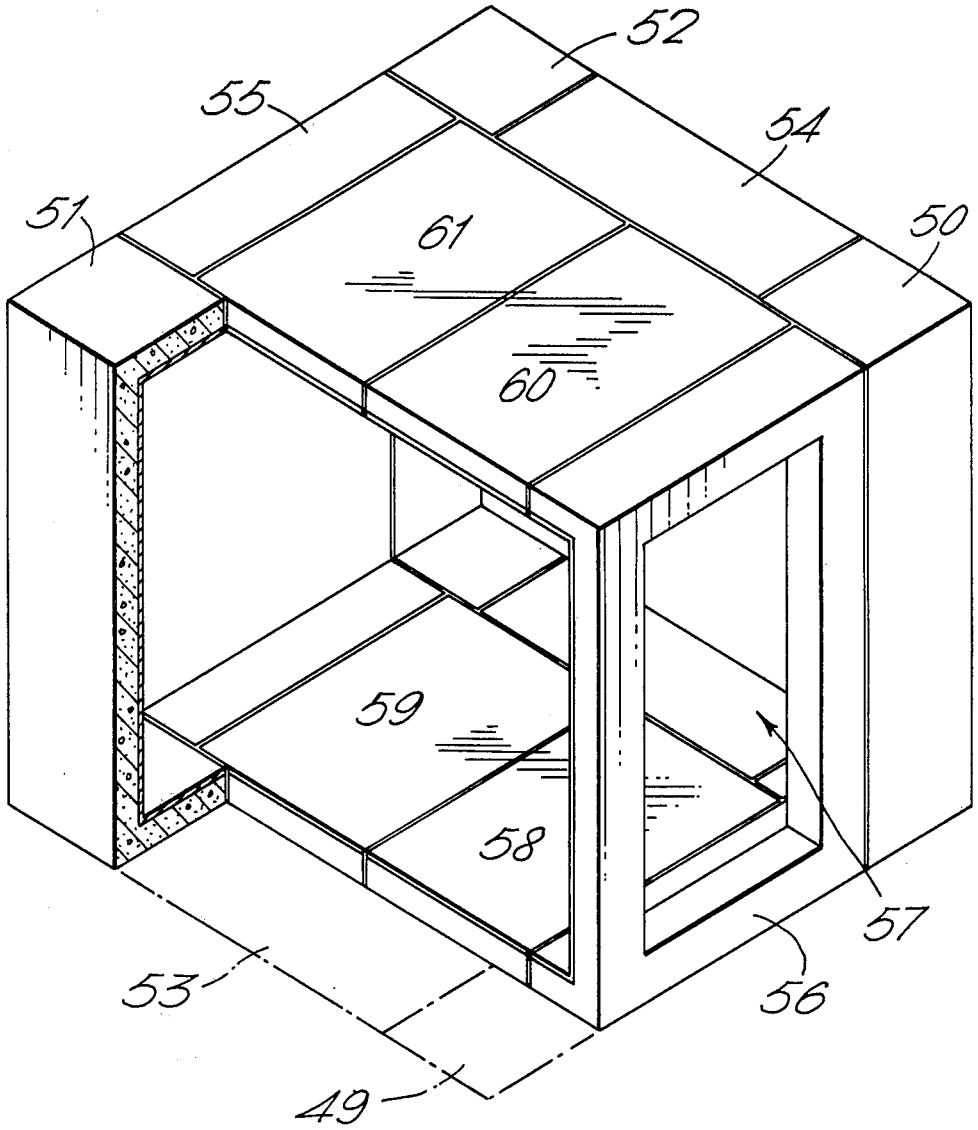
FIG. 13 is an isometric view of a third embodiment of a vault in accordance with the invention, with two panels omitted for clarity.

Another embodiment of a pre-fabricated vault in accordance with the invention is shown in FIGS. 13 and 14. In this case there are four corner panels 49–52 each of which extends in four planes to define portions not only of the two adjacent sides of the assembled vault but also of the floor and roof. There are also three side/rear panels 53–55 each of which also has lower and upper "returns" to define portions of the floor and roof of the assembled vault. Finally there is also a front panel 56 with a preformed door opening 57 but otherwise equivalent to the side and rear panels; two floor panels 58 and 59; and two roof panels 60 and 61. The form of construction employed for these panels is essentially the same as for those previously described. Also, although not shown in FIG. 13, the joints between adjacent panels will be lapped as previously described, and may be secured by screws and flitch plates as previously described.

Figure 15:
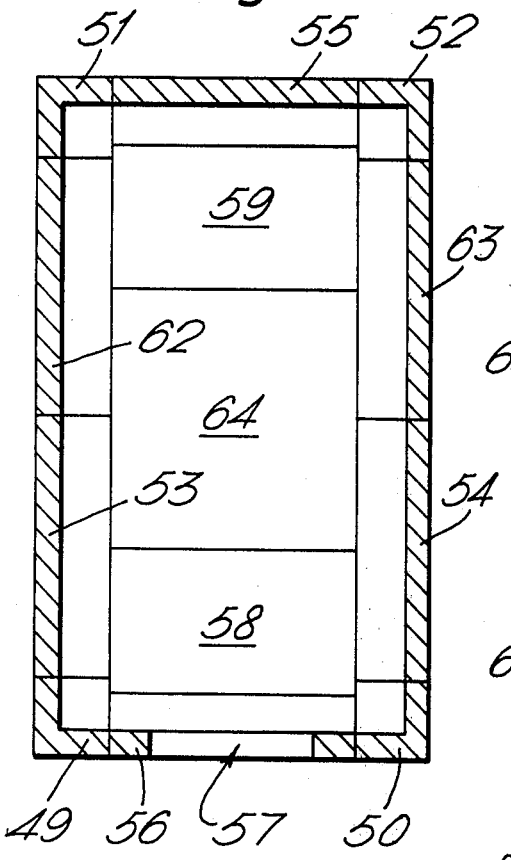
FIG. 15 is a horizontal section through an extended version of the vault of FIG. 13.
Figure 16:
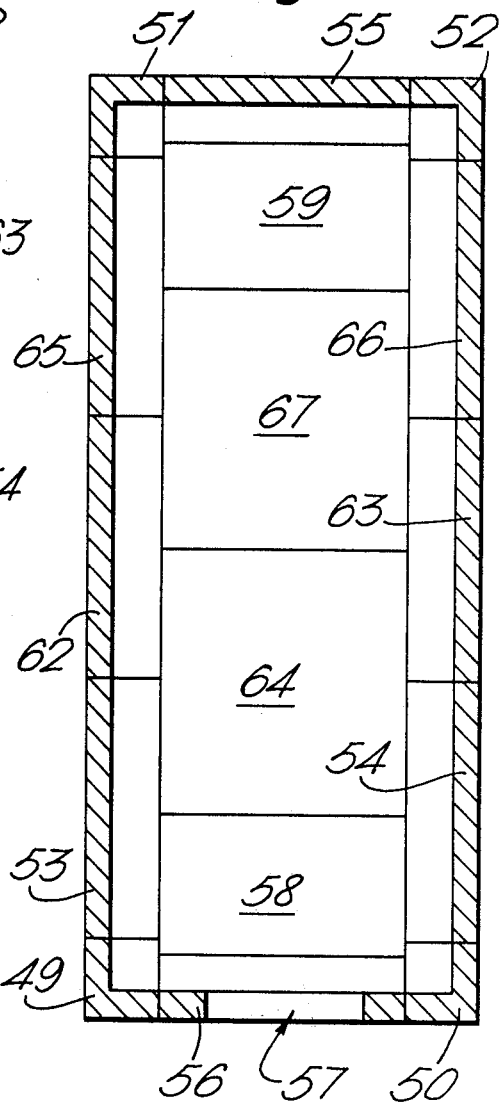
FIG. 16 is a horizontal section through a further extended version of the vault of FIG. 13.

FIGS. 15 and 16 are sectional plan views of extended versions of the vault of FIGS. 13 and 14. In FIG. 15 the depth of the vault has been extended by the addition of two side panels 62 and 63, a floor panel 64 and a corresponding roof panel. In FIG. 16 the depth of the vault has been further extended by the addition of two more side panels 65 and 66, another floor panel 67 and a corresponding roof panel. As will be appreciated, further incremental increases in the size of the vault can be made in the same fashion up to any desired value.

Figure 17:
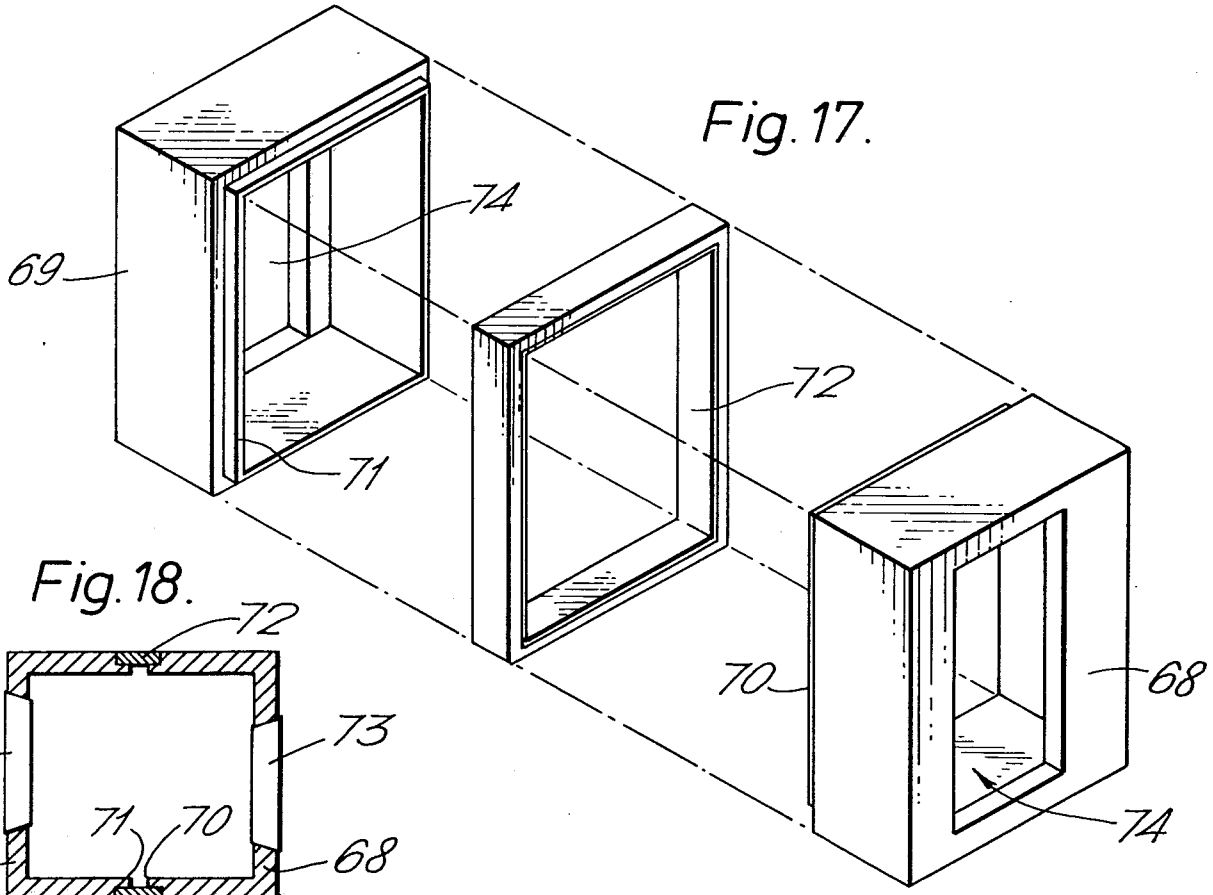
FIG. 17 is a partially "exploded" view of the panels employed to make up a fourth embodiment of a vault in accordance with the invention.
Figure 18:
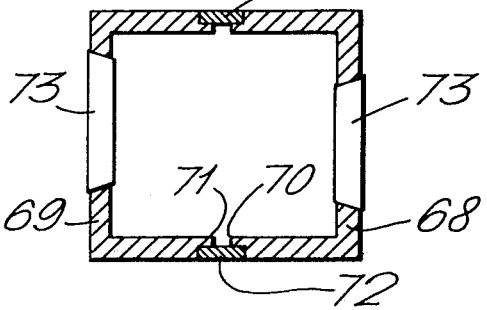
FIG. 18 is a horizontal section through the assembled vault of FIG. 17.

FIGS. 17 and 18 illustrate a still further embodiment of a pre-fabricated vault in accordance with the invention. In this there are two identical end panels 68 and 69, each of which extends in five planes to define the whole of one side and portions of the two adjacent sides, roof and floor of the assembled vault. Each panel terminates in a stepped rectangular portion 70,71, which interfits with a rectangular joining ring 72. The end panels are, as before, of a fibre-reinforced concrete on steel construction, while the element 72 comprises an inner steel ring bearing a layer of Aloxite (Registered Trade Mark) nuggets in an aluminium matrix. The panels may be secured together e.g. by means of screwed longitudinal corner angles and/or longitudinal plates at mid-height (sides) and mid-width (roof) positions.

As envisaged, an embodiment such as illustrated in FIGS. 17 and 18 would have a smaller internal volume than the basic vault modules of FIGS. 2, 11 and 13 for example. In order to make the best use of its internal volume, therefore, there may be a door 73 at each end of the vault, for which purpose each panel 68 and 69 is provided with a preformed door opening 74. Extension of the size of a vault of this type may be accomplished by incorporating ring-like body panels between pairs of joining rings 72 in series between the end panels 68 and 69.

We claim:

1. A security enclosure constructed by assembling together in demountable fashion a plurality of separate, pre-fabricated panels, wherein each perpendicular corner of the assembled enclosure is provided in at least one panel which extends integrally from the respective corner to define significant portions of both of the adjacent sides of the enclosure, and wherein at least each such corner panel is provided with a penetration-resistant barrier consisting essentially of a fibre-reinforced concrete material.

2. An enclosure according to claim 1 wherein all of the panels which define the body of the enclosure are provided with respective penetration-resistant barriers each consisting essentially of a fibre-reinforced concrete material.

3. An enclosure according to claim 1 wherein each said barrier comprises fibres of steel or polypropylene.

4. An enclosure according to claim 3 wherein each said barrier comprises fibres of steel which are present in an amount representing 2½–5% by weight of the concrete material.

5. An enclosure according to claim 3 wherein each said barrier comprises fibres of steel having lengths in the range 20–80 mm and diameters in the range 0.3–1 mm or equivalent non-circular cross-sectional areas.

6. An enclosure according to claim 1 wherein each said barrier further includes particles of sintered or fused alumina in an amount representing 10–40% by volume of the concrete material.

7. An enclosure according to claim 1 wherein each said panel is prepared by casting the concrete material onto a respective steel plate which plate has a plurality of anchors extending therefrom to lie within the cast concrete material to resist separation of the concrete material, when set, from the plate.

8. An enclosure according to claim 1 wherein each said panel comprises a steel plate to which a slab of said concrete material is secured, the respective plates being disposed inwardly in relation to the assembled enclosure, and wherein pairs of adjacent panels are connected together along adjacent vertical edges by means of a respective connecting plate welded to the plate of a first such panel and overlapping the adjacent edge of a second such panel, the connecting plate being secured to the second such panel by removable fastening means.

9. An enclosure according to claim 1 comprising four said corner panels, two said corner panels being interconnected by a uni-planar panel to define a first side of the assembled enclosure, a space between the free edges of the other two said corner panels defining a door opening for the assembled enclosure, in a second side thereof opposite to said one side, and a uni-planar panel providing the roof of the assembled enclosure.

10. An enclosure according to claim 9 further comprising n similar uni-planar panels interposed between two said corner panels in each of the third and fourth sides of the assembled enclosure and n similar uni-planar panels serially disposed in the roof thereof, wherein n is any whole number.

11. A pre-fabricated panel for a security enclosure, the panel being generally of L-shaped plan form so as to define significant portions of two adjacent sides of the enclosure when assembled, and wherein the panel is provided with a penetration-resistant barrier consisting essentially of a fibre-reinforced concrete material.

12. A panel according to claim 11 wherein said barrier comprises fibres of steel or polypropylene.

13. A panel according to claim 12 wherein said barrier comprises fibres of steel which are present in an amount representing 2½%–5% by weight of the concrete material.

14. A panel according to claim 12 wherein said barrier comprises fibres of steel having lengths in the range 20–80 mm and diameters in the range 0.3–1 mm or equivalent non-circular cross-sectional areas.

15. A panel according to claim 11 wherein said barrier further includes particles of sintered or fused alumina in an amount representing 10–40% by volume of the concrete material.

16. A panel according to claim 11 prepared by casting the concrete material onto a steel plate which plate has a plurality of anchors extending therefrom to lie within the cast concrete material to resist separation of the concrete material, when set, from the plate.

* * * * *